United States Patent [19]

Gomez

[11] Patent Number: 4,645,037

[45] Date of Patent: Feb. 24, 1987

[54] ELEVATOR ESCAPE STRUCTURE

[76] Inventor: Samuel Gomez, 712 SW. 56 Ave., #8, Miami, Fla. 33134

[21] Appl. No.: 736,953

[22] Filed: May 22, 1985

[51] Int. Cl.[4] ..... B66B 9/00; E04F 11/00

[52] U.S. Cl. ..... 187/1 R; 52/30; 52/185

[58] Field of Search ..... 187/1 R, 62, 51, 12, 187/10, 32, 56, 52; 182/49, 83; 52/30, 185, 184, 186; 49/68

[56] References Cited

U.S. PATENT DOCUMENTS

| | | | |
|---|---|---|---|
| 373,587 | 11/1887 | Haas | 187/1 R |
| 1,060,969 | 5/1913 | Boldizzoni | 187/56 C |
| 1,977,706 | 10/1934 | Watts | 187/1 R |
| 3,012,633 | 12/1961 | Magee | 182/18 X |
| 3,258,885 | 7/1966 | Lodige | 52/169.6 X |
| 4,004,655 | 1/1977 | Kraft et al. | 187/56 X |

FOREIGN PATENT DOCUMENTS

| | | | |
|---|---|---|---|
| 1456348 | 11/1968 | Fed. Rep. of Germany | 187/56 |

*Primary Examiner*—F. J. Bartuska
*Assistant Examiner*—Gregory L. Huson
*Attorney, Agent, or Firm*—John Cyril Malloy

[57] ABSTRACT

This invention relates to an elevator shaft structure in a building about an elevator to aid escape from the elevator upon a power failure; and it includes a structure defining an elevator shaft for an elevator cab which provides a rear shaft wall with a stairway extending outwardly from the rear wall for travel between the floors and, in the elevator cab, a rear door is provided for escape from the elevator onto the emergency stairway.

4 Claims, 3 Drawing Figures

ELEVATOR ESCAPE STRUCTURE

FIELD OF THE INVENTION

This invention relates to an escape device for an elevator, which is equipped with a rear door as well as the conventional front door; and, more particularly, to an elevator shaft with a rear wall provided with a stairway between the floor of a building as shown and described, so that if the elevator is stopped between floors, for example in a hurricane power failure, or other type failure, people in the elevator may exit the elevator through the rear door and onto the stairway to proceed up or down it to one of the building floors.

BACKGROUND OF THE INVENTION

In the past, notwithstanding every effort to provide devices to insure that elevators do not get stuck between floors, it does occur all too often that people are trapped, sometimes for extended periods of time which is very unnerving and, in some cases, highly dangerous.

To provide an escape, some elevator roofs are provided with escape hatches; however, this is at best an attempt to provide a difficult and cumbersome escape path. Accordingly, efforts have continued to solve the elevator problem and efforts in this regard are found in the prior art, for example in the following U.S. Pat. Nos. 373,587; 1,977,706; 3,012,633; and 3,258,885.

OBJECTS OF THIS INVENTION

It is an object of this invention to provide an elevator shaft which provides, between floors and extending into the shaft and the rear wall, a stairway means so that, when an elevator cab is stopped between floors, a rear door of the elevator cab may be opened and people within the elevator may pass through the rear door onto the stairway to move up or down to the building floors proper and escape from the elevator cab.

Accordingly, it is an object of this invention to provide an improved safety device for use in elevators and which is strong and durable, part of the building, and which is permanent in its providing for the escape of people trapped within an elevator in the building.

In accordance with these and other objects which will become apparent hereinafter, the instant invention will now be described with reference to the accompanying drawings in which:

DESCRIPTION OF THE PREFERRED EMBODIMENT

Figure 1:
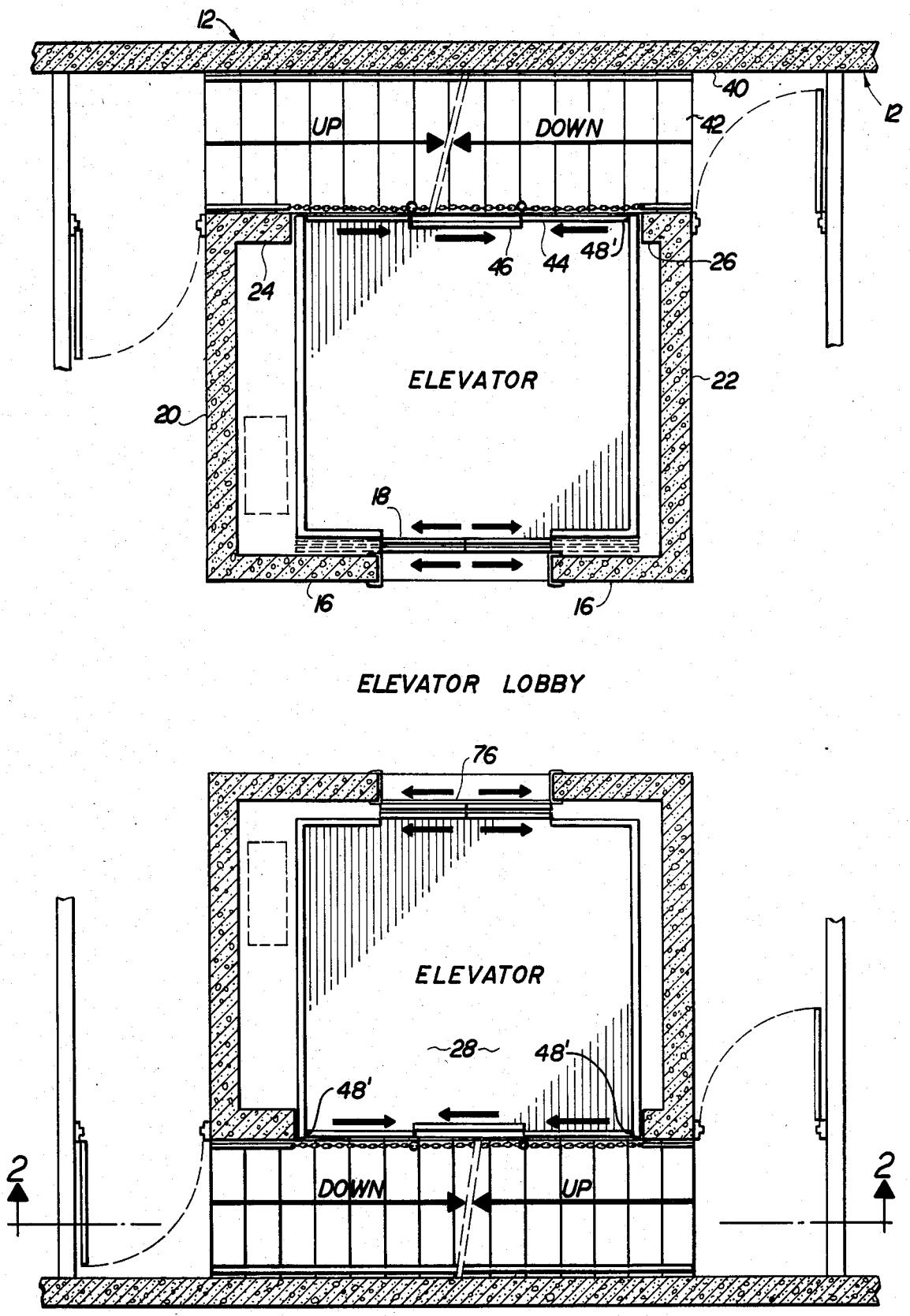
FIG. 1 is a plan view of an elevator lobby of a building constructed in accordance with this invention.

Referring to the drawings wherein like reference characters designate like or corresponding parts throughout the several views, there is shown a multi-story building having a wall 12 and elevator shafts such as 14 in the building defined by a vertical front wall 16 and vertical side walls 20 and 22 extending from the front wall and P261/1.61 ending at turned in ends as at 24 and 26. The elevator shaft 14 is sized for vertical movement of an elevator cab in the shaft, and it is shown at several locations, see FIG. 2, as at 28, 28' and 28''.

The floors of the building are represented as at 50, 52, 54 and 56 and a pair of access doors such as 58 and 60 are provided onto each of the floors from the elevator shaft. It will be seen that there has been provided a conventional lift drive means 30 which is suitably connected to move the lift or elevator cab vertically in the shaft. Between the floors, that is between the doors, for example 57 and 58, a stairway flight such as 42, 42' and 42'' is provided. It is supported in cantilever fashion by the building and more particularly the rear elevator shaft wall. It extends from adjacent one of the side walls to the other of the side walls and out into the elevator shaft from the rear wall in close side-by-side relation to the ends of the side walls with the outer edge of the stairway in effect providing a partial rear wall for the elevator shaft. Within the elevator cab, in the rear wall 44, a door 46, preferably a by-pass or sliding door is provided in closing relation to a door opening 48. This door is opposite the main entrance door at the front of the cab 76 which opens automatically. The rear door 46 is operated manually or electrically by sliding it either to the left or to the right as required when the elevator has been stuck between floors, so that one may open it and step out through opening 48 substantially along the length of the opening between opposite ends 48' (see FIG. 2) onto the stairway. It will be noted that the elevator may be in various positions between a floor but that the arrangement of the rear doors in the center of the rear wall of the elevator cab provides that a person may escape therefrom at any level in which the elevator has stopped.

It is thus seen that there has been provided a simple and inexpensive structure by which one may provide escape for elevators stuck between floors in new constructions.

Figures 2, 3:
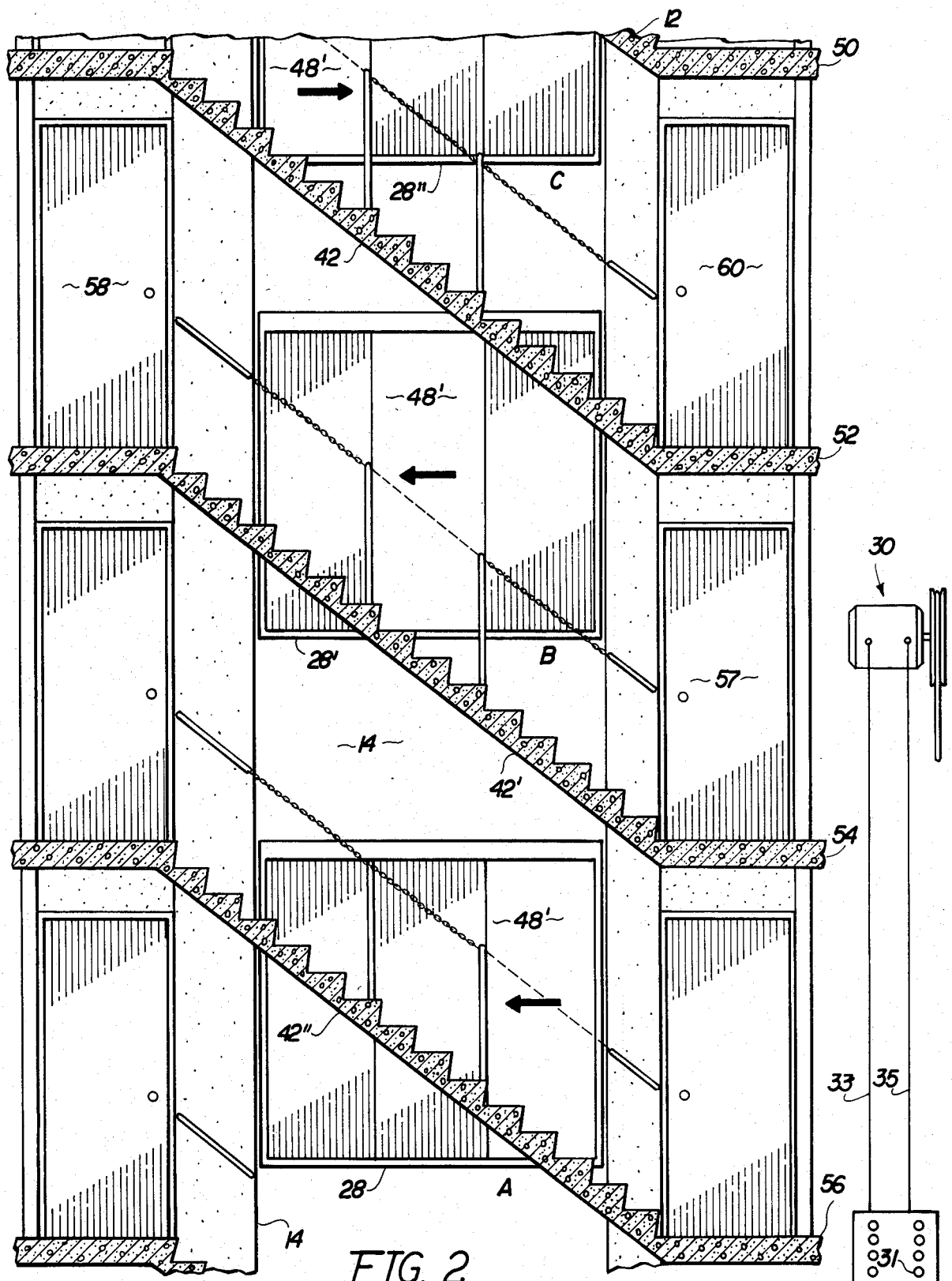
FIG. 2 is an elevation view in cross-section through one of the emergency stairwells and taken on the plane indicated by the line 2—2 of FIG. 1 and looking in the direction of the arrows.
FIG. 3 is a circuit diagram illustrating a master switch and conventional drive means of the lift or elevator.

As shown in FIG. 3, the drive means 30 includes in a preferred embodiment the motor and a switching panel 31 to which conductors 33 and 35 supply power and in which there is provided a master switch 39. In use, the rear door of the elevator cab may be adapted to open the main power circuit so that when the power is off, the switch 39 will be opened so that the elevator cannot move even if power is restored and people may escape from the elevator without fear of injury. In the preferred embodiment, the main switch will open if there is a power failure and cannot be closed except by a positive act. Also, if power fails an emergency battery powered light system, not shown, for the cab, shaft and stairway will be activated.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. In a multi-story building having at least one floor at one level and an other floor at another level, and having an elevator shaft with a front elevator lobby wall with an entrance opening into said shaft at each floor for ingress and egress, a pair of side walls each extending from the front elevator lobby wall to an oppositely disposed end of each side wall, an elevator cab sized to move vertically between the front and side walls in the shaft, and said elevator cab including lift means operatively connecting the elevator cab and the building, the improvement comprising:

(a) a rear wall disposed parallel to the front wall and spaced from the ends of the side wall a predetermined distance, (b) a stair structure fixedly secured to the building and disposed between the rear wall and the ends of the side walls, (c) said stair structure being elongated and extending substantially between one of the pairs of side wall ends and the one floor and the other of the pairs of side wall ends at the other floor, (d) the elevator cab having an elevator rear wall disposed substantially between the ends of the pair of side walls and a door opening in the elevator rear wall substantially extending across the entire elevator cab and along a majority of the length of the stair structure, (e) a door mounted in said elevator cab and comprising a plurality of segments movable relative to one another and selectively positionable relative to the door opening to open at least either of two opposite ends of the door opening for direct access to the stair structure, and (f) the stair structure angularly oriented between floors and accessible from the elevator cab through at least one of the two opposite ends of the door opening regardless of the level of the elevator cab relative to the stair structure.

2. The device as set forth in claim 1 wherein guide means are provided along said stair structure adjacent said ends of said side walls.

3. The device as set forth in claim 1 wherein said lift means includes a disconnecting switch means, said switch means being normally closed and including means to open a circuit structured to connect a power supply and said lift means for interruption of power to said lift means, said switch means remaining open until selectively closed when power is interrupted to said lift means.

4. The device as set forth in claim 1 wherein said door comprises a sliding panel construction including a first, second and third segment spanning said elevator rear wall and said segments being slidable relative to one another in covering relation to said door opening, each of said segments being selectively positionable relative to the other segments to provide access through said door opening to said stair structure at different levels between said floors.

* * * * *